US005149288A

United States Patent [19]

Kelley

[11] Patent Number: 5,149,288

[45] Date of Patent: Sep. 22, 1992

[54] TOY FIGURE WITH INTERCONNECTED RETRACTABLE HAIR AND TAIL

[75] Inventor: William J. Kelley, Torrance, Calif.

[73] Assignee: Mattel, Inc., El Sequndo, Calif.

[21] Appl. No.: 772,621

[22] Filed: Oct. 3, 1991

Related U.S. Application Data

[63] Continuation of Ser. No. 574,076, Aug. 29, 1990, abandoned.

[51] Int. Cl.[5] ..... A63H 3/44; A63H 3/36

[52] U.S. Cl. ..... 446/319; 446/320

[58] Field of Search ..... 446/295, 296, 320, 321, 446/319, 394, 376

[56] References Cited

U.S. PATENT DOCUMENTS

| | | | |
|---|---|---|---|
| 2,448,088 | 8/1948 | Driggs | 446/320 |
| 2,708,809 | 5/1955 | Peterson | 446/320 X |
| 3,828,467 | 8/1974 | Kaelin | 446/320 |

FOREIGN PATENT DOCUMENTS

| | | | |
|---|---|---|---|
| 2300016 | 7/1973 | Fed. Rep. of Germany | 446/319 |
| 2508812 | 1/1983 | France | 446/319 |
| 226448 | 12/1924 | United Kingdom | 446/319 |

*Primary Examiner*—Danton D. DeMille

[57] ABSTRACT

A toy representing an animal including a body portion, a pair of openings in the body portion, strands of material representing a first appendage projecting externally through one of the openings, strands of material representing a second appendage projecting externally through the second of the openings, and means connecting the strands of material representing a first appendage to the strands of material representing a second appendage within the body of the toy whereby withdrawing a portion of one of the strands of material causes the other of the strands of material to draw into the body of the toy.

7 Claims, 2 Drawing Sheets

TOY FIGURE WITH INTERCONNECTED RETRACTABLE HAIR AND TAIL

This is a continuation of application Ser. No. 07/574,076 filed Aug. 29, 1990 now abandoned.

FIELD OF THE INVENTION

This invention relates to toy figures and, more particularly, to toy figures having interconnected hair and tail elements which may be moved to varying positions.

HISTORY OF THE PRIOR ART

There has always been a fascination shown by children with the various aspects of grooming. Consequently, dolls with combable hair have proliferated. A number of dolls have extended this feature and added play value through arrangements by which the length of the hair may vary under control of the child. U.S. Pat. Nos. Re. 27,267 to Lilienstein, 2,537,536 to Lilienstein, 3,696,551 to Sklarsky et al, and 3,670,451 to Groves et al illustrate various such dolls and arrangements for varying the length of the hair.

The prior art has also known toy animals with hair or fur which may be variously manipulated. For example, U.S. Pat. No. 3,313,060 to Mobley, Jr. shows a toy animal with attachable floppy ears. U.S. Pat. No. 4,685,893 to Perkitay et al illustrates a toy animal with ears and a tail and a doll with hair, the length of the ears, tail, and hair all being variable by apparatus which allows those parts to be bunched externally.

There has, however, been no known case in which the hirsute appendages of a toy animal have been rendered variable by apparatus internal to the toy and in a manner in which the variation of one such appendage affects the length of the other.

SUMMARY OF THE INVENTION

It is therefore, an object of the present invention to provide a toy animal having both a tail and either ears or a mane both of which are variable in length within the toy.

It is another more specific object of the present invention to provide a toy animal having both a tail and either ears or a mane both of which are interrelatedly variable in length within the toy.

These and other objects of the present invention are realized in a toy representing an animal comprising a body portion, a pair of openings in the body portion, strands of material representing a first appendage projecting externally through one of the openings, strands of material representing a second appendage projecting externally through the second of the openings, and means connecting the strands of material representing a first appendage to the strands of material representing a second appendage within the body of the toy whereby withdrawing a portion of one of the strands of material causes the other of the strands of material to draw into the body of the toy.

These and other objects and features of the invention will be better understood by reference to the detailed description which follows taken together with the drawings in which like elements are referred to by like designations throughout the several views.

DETAILED DESCRIPTION OF THE INVENTION

Figure 1:
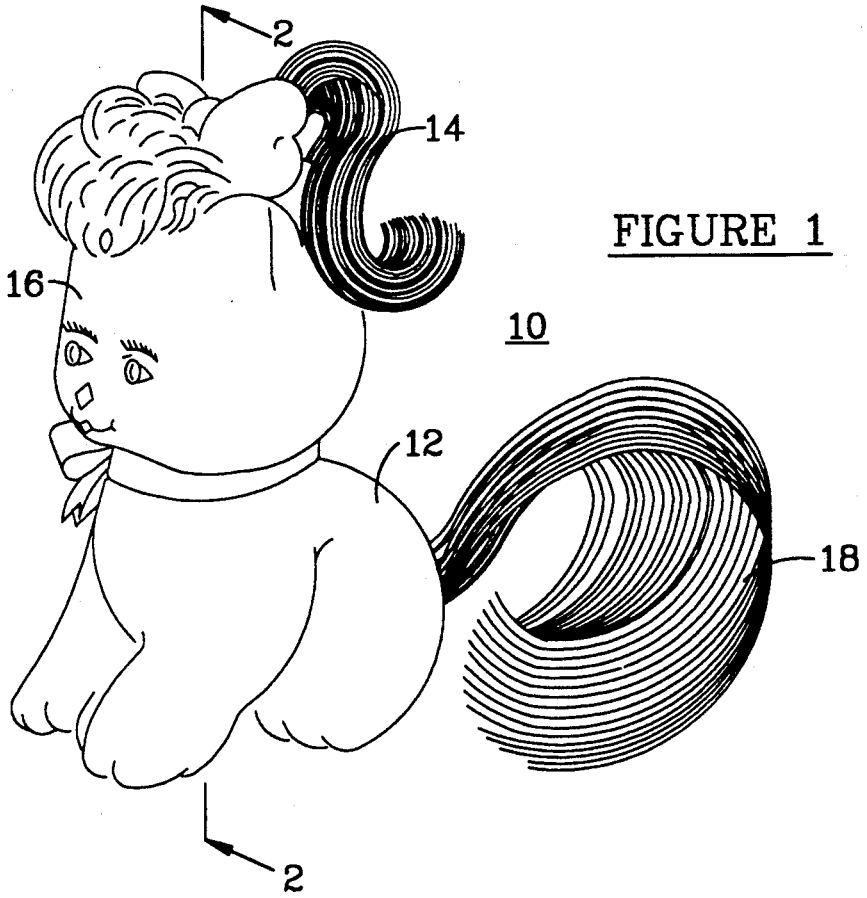
FIG. 1 is an isometric view of a toy animal constructed in accordance with the invention.

Referring now to FIG. 1 there is illustrated a toy animal 10. The animal 10 may have a body 12 constructed of any of a number of materials used in the manufacture of toys. For example, the body may be constructed of a soft or hard plastic material designed to provide structural support for the internal arrangement described hereinafter. It is possible that the body of the doll might be constructed of soft materials such as plush materials if an internal structure were to be provided for supporting the internal arrangement described hereinafter. In any case, the toy may depict any of a number of animals which have both ears and a tail, a mane and a tail, or any two externally projecting generally-hirsute appendages. In the preferred embodiment, these appendages are formed of plastic fibers. Although the preferred embodiment of the invention represents a toy animal having a mane and tail, the appendages might also represent whiskers, plumes, feathers, or the like.

The toy 10 is designed so that a portion of each of at least two of the appendages are connected together, either directly or by some intermediary arrangement. An externally-extending portion, for example, of a mane 14 of the toy 10 which projects from a head 16 is connected within the toy 10 to an externally-extending portion of a tail 18 which projects from the rear of the toy 10. When a child pulls on the portion of the mane 14, the portion of the mane 14 external to the toy 10 lengthens while, as a concomitant, the portion of the tail 18 external to the toy 10 shortens. Consequently, a child may manipulate the toy 10 to provide a number of different visual impressions. This ability substantially enhances the play value of the toy 10.

Figure 2:
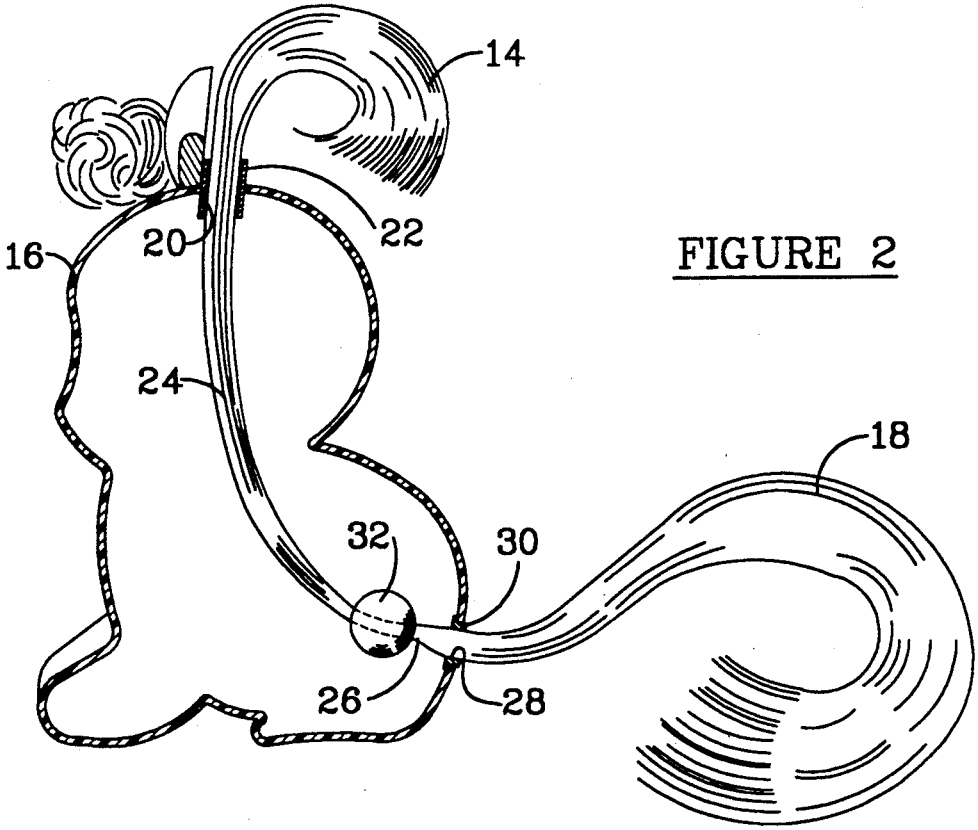
FIG. 2 is a cross-sectional view of the toy animal of FIG. 1.

The manner in which this desirable facility is attained is illustrated in FIG. 2 which is s cross-sectional view of the toy 10 taken along the line 2—2 in FIG. 1. FIG. 2 illustrates the manner in which the preferred embodiment of the invention, is constructed. In the cross section, it may be seen that the head 16 of the toy 10 has an opening 20 therein through which projects the external portion of the mane 14. The opening 20 through which the exterior portion projects may have a soft plastic or other material 22 surrounding the opening 20 in a manner that it bears against and retards the issuing of the external portion of the mane 14 from the toy 10 when a force is applied to the external portion by a child.

As may be seen in FIG. 2, an internal portion 24 of the mane 14 runs through the interior of the body 12 of the toy 10. In the simplest embodiment of the invention, the internal portion 24 is connected to and a part of an internal portion 26 of the tail 18 which in turn extends to become the external portion of the tail 18. A second opening 28 is provided in the rear of the toy 10 through which the external portion of the tail 18 projects. As with the mane, the opening 28 through which the exterior portion of the tail 18 projects may have a soft plastic or other material 30 surrounding the opening 28 and bearing against and retarding the issuing of the external portion of the tail 18 from the toy 10 when a force is applied to the external portion of the tail 18. In the case in which the body of the toy 10 is constructed of a soft plastic material which provides this retarding effect or some other means provides this effect, the material 30 may be omitted.

A bead 32 may be permanently attached to the center of the material which internally constitutes the mane and tail. In one embodiment, such a bead 32 may be a round plastic ball which is formed to tightly hold the plastic fibers which constitute the mane and tail. In another embodiment, the bead may be formed by placing a knot in the strands which form the internal portions of the mane 14 and the tail 18. The bead 32 is of a size such that it provides a stop at the openings 20 and 28 and thus limits the extent to which either the tail 18 or the external portion of the mane 14 may projects from the body 12 of the toy 10. In order to assure that neither the mane nor the tail is pulled into the inside of the toy 10 by the withdrawal of the other appendage, the length of the mane (and of the tail) from the bead 32 to the end of the appendage must be longer than (approximately) the distance between the openings 20 and 28.

Figure 3:
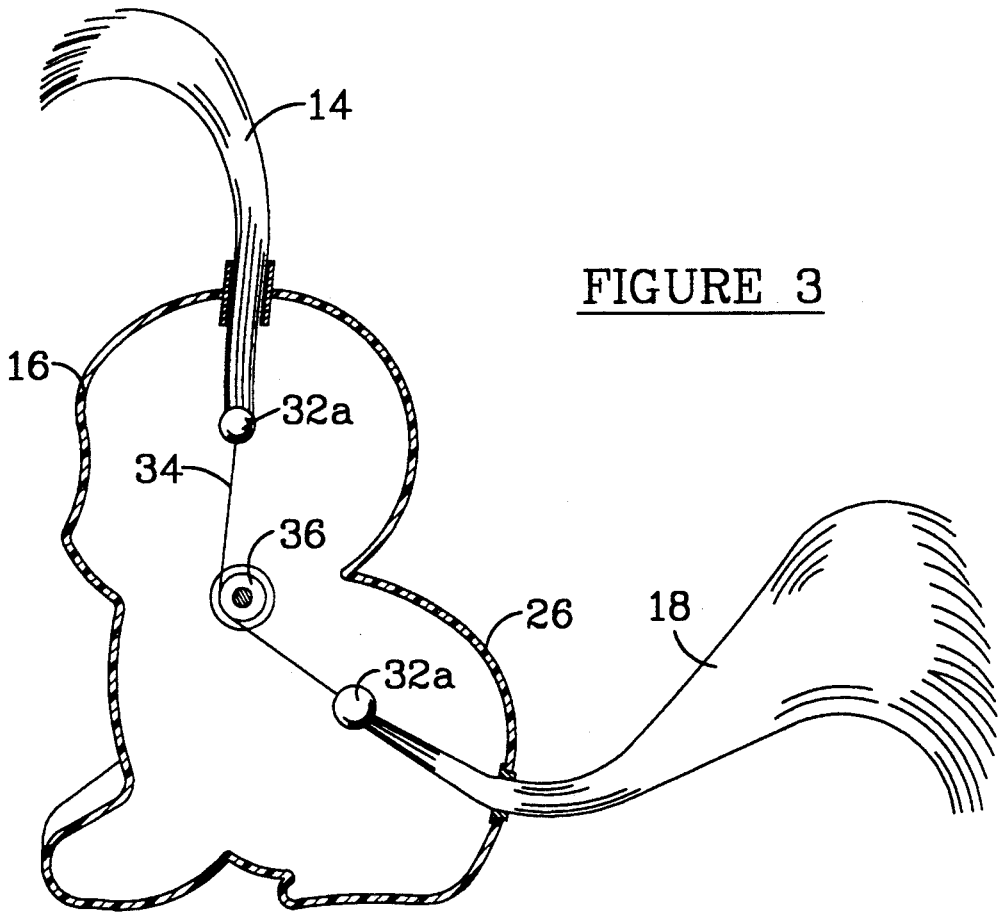
FIG. 3 is a cross-sectional view of an alternative version of the toy animal of FIG. 1.

It will be recognized by those skilled in the art that the mane and tail of the toy 10 need not be directly connected to one another for the invention to function in a correct manner. For example, an intervening mechanism may connect the mane and tail together so that a pull on one of the two is conveyed to the other as is shown in FIG. 3. In such a case, a stop 32*a* acting like the bead 32 must be provided on each of the mane and tail so that the internal connecting mechanism will not be pulled out and displayed outside of the toy. In FIG. 3, a connector 34 joins the beads 32*a* together and runs over a pulley 36 in order to change the direction of the pull on the two appendages.

Figure 4:
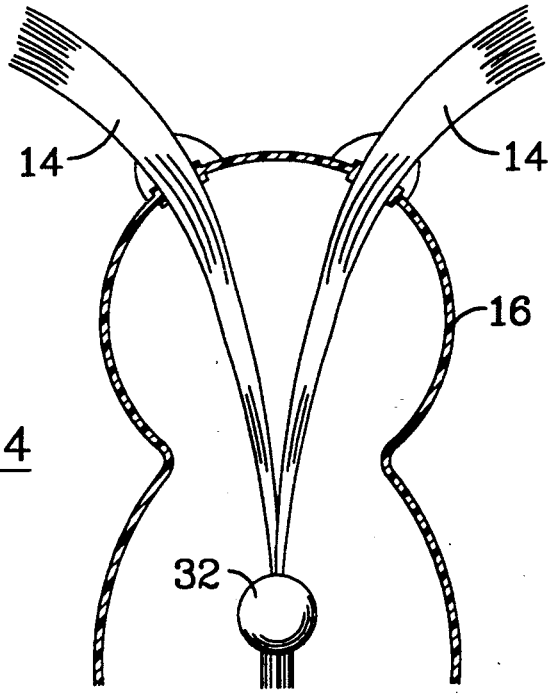
FIG. 4 is a cross-sectional view of another alternative version of the toy animal of FIG. 1.

It will also be recognized by those skilled in the art that other extremities than mane and tail might be internally connected to offer like play value. For example, FIG. 4 illustrates an arrangement in which a tail might be connected to an ear of a toy animal. In the particular embodiment of the arrangement, the mane 14 (now a pair of ears) illustrated may be designated to divide into two external portions in a manner which provides a pair of ears issuing from openings in the head of the toy 10, for example.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A toy representing an animal comprising a body portion, at least a pair of openings in the body portion; loose strands of groomable material representing a first hirsute appendage of the animal represented projecting externally through one of the openings, loose strands of groomable material representing a second hirsute appendage of the animal represented projecting externally through the second of the openings, and means connecting the loose strands of groomable material representing a first hirsute appendage to the loose strands of groomable material representing a second hirsute appendage within the body of the toy whereby withdrawing a portion of one of the loose strands of groomable material causes the other of the loose strands of groomable material to draw into the body of the toy.

2. A toy representing an animal as claimed in claim 1 in which the portion of each of the pair of openings is constructed of a soft material which bears against and retards the withdrawal of material through the opening.

3. A toy representing an animal as claimed in claim 1 in which the means connecting the loose strands of groomable material representing a first appendage to the loose strands of groomable material representing a second appendage within the body of the toy comprises extensions of the loose strands of groomable material.

4. A toy representing an animal as claimed in claim 1 further comprising stop means for precluding the loose strands of groomable material representing a first hirsute appendage and the loose strands of groomable material representing a second hirsute appendage from being completely withdrawn from the body of the toy.

5. A toy representing an animal as claimed in claim 4 in which the means connecting the loose strands of groomable material representing a first hirsute appendage to the loose strands of groomable material representing a second hirsute appendage within the body of the toy comprises extensions of the loose strands of material, and the stop means comprises a bead joined to the extensions of the loose strands of groomable material.

6. A toy representing an animal as claimed in claim 4 in which the means connecting the loose strands of groomable material representing a first hirsute appendage to the loose strands of groomable material representing a second hirsute appendage within the body of the toy comprises extensions of the loose strands of groomable material, and the stop means comprises a knot placed in the extensions of the loose strands of groomable material.

7. A toy representing an animal as claimed in claim 4 in which the stop means comprises first stop means associated with the loose strands of groomable material representing a first hirsute appendage and second stop means associated with the loose strands of groomable material representing a second hirsute appendage within the body of the toy.

* * * * *